United States Patent [19]

O'Leary et al.

[11] Patent Number: 4,964,662

[45] Date of Patent: Oct. 23, 1990

[54] PORTABLE DOOR SECURING DEVICE

[76] Inventors: Timothy J. O'Leary, 853 Stryker Ave., St. Paul, Minn. 55107; Roger R. Brown, 8755 Hamlet Ave. S., Cottage Grove, Minn. 55016

[21] Appl. No.: 498,414

[22] Filed: Mar. 26, 1990

[51] Int. Cl.[5] ..... E05C 19/18

[52] U.S. Cl. ..... 292/295

[58] Field of Search ..... 411/514; 292/292, 295, 292/298, 290, 293, 294, 288

[56] References Cited

U.S. PATENT DOCUMENTS

| | | | |
|---|---|---|---|
| 2,510,897 | 6/1950 | MacLean, Jr. et al. | 411/514 |
| 2,903,286 | 9/1959 | Richard et al. | 292/295 |
| 3,161,428 | 12/1964 | Zook | 292/292 |
| 3,731,965 | 5/1973 | Adkinson, Jr. | 292/292 |
| 3,844,598 | 10/1974 | Clahaugh | 292/295 |
| 4,506,527 | 3/1985 | Grill | 292/295 |

*Primary Examiner*—Richard E. Moore

*Attorney, Agent, or Firm*—Jacobson and Johnson

[57] ABSTRACT

A press fitted stud on one end of a metal strip is hooked into the opening of a striker plate in a door jamb and the strip extends in the space between the jamb and the edge of the door past the jamb and closed door. The extended end of the plate has holes for receiving a knurled locking pin which holds a locking plate tightly against the closed door and the door jamb to keep the door securely closed. Resilient pads of different thickness and compressibility on the locking plate facing the door keep the door tightly closed.

3 Claims, 1 Drawing Sheet

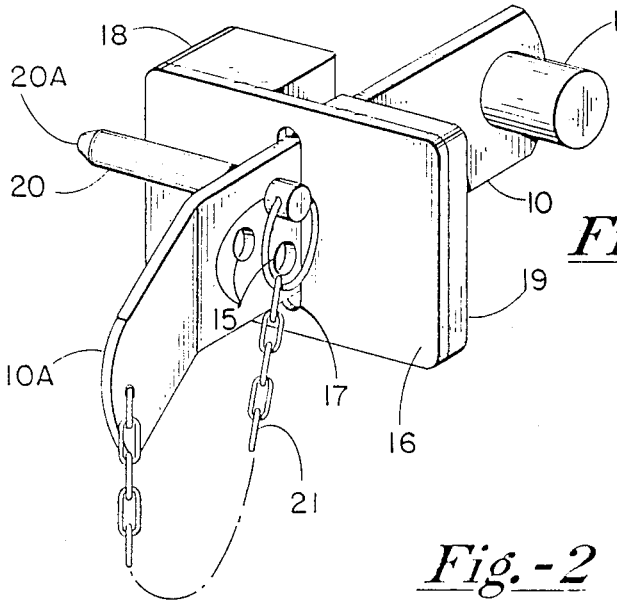
Fig.-1 (PRIOR ART)
Fig.-2
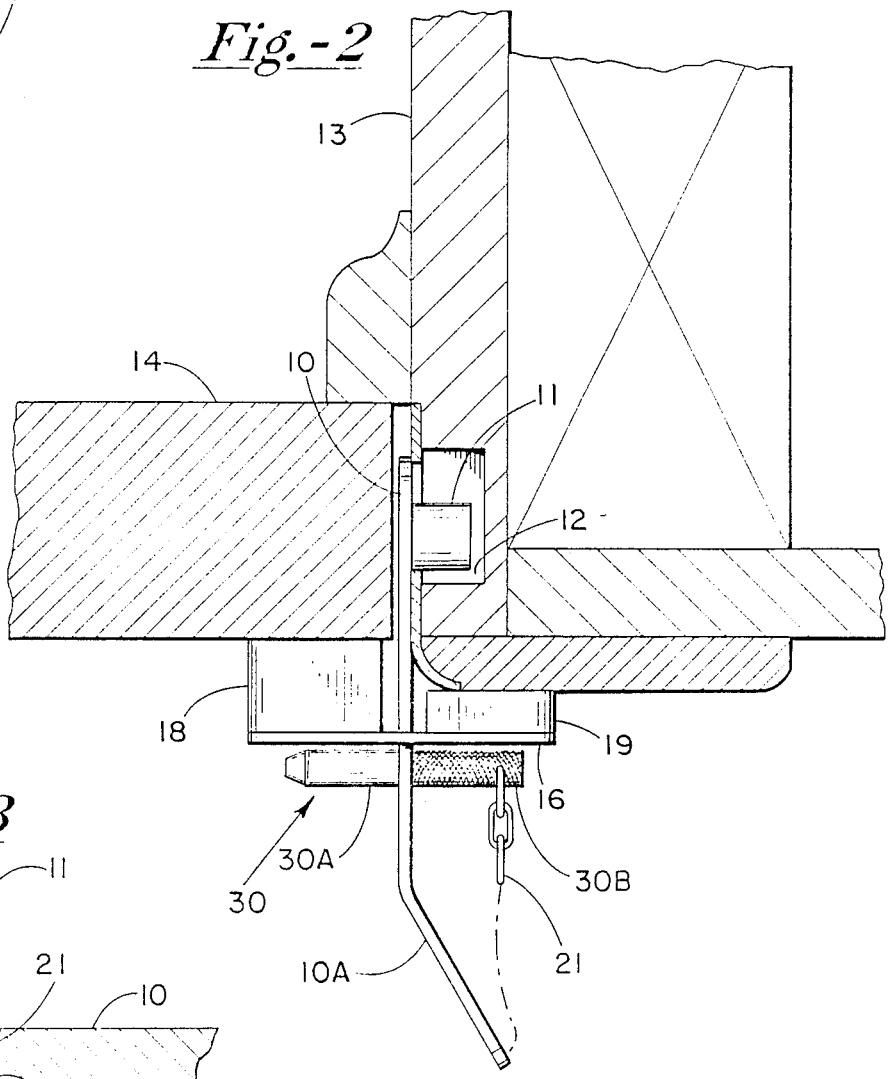
Fig.-3
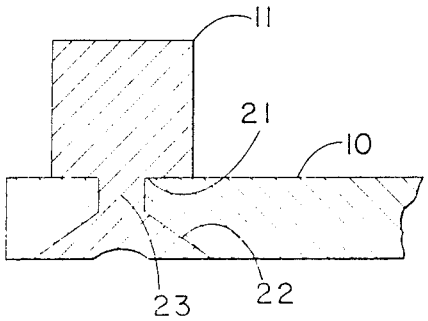

PORTABLE DOOR SECURING DEVICE

FIELD OF THE INVENTION

This invention is a portable door-securing device which can be readily attached by an occupant of a room from the inside to hold the door securely closed and yet be readily and quickly removed to open the door. It is used in addition to conventional deadbolt locks and requires no modification to conventional doors, door frames or jambs.

DESCRIPTION OF THE PRIOR ART

The closest prior art is a commercially available device. The instant invention is an improvement over this prior art.

SUMMARY OF THE INVENTION

Similar to the prior art, an elongated rigid strip has a stud near one end for engaging the striker plate hole in a door jamb and extends from the striker plate hole into the interior of the room through the gap between the closed door and the door jamb. The extended portion has a series of equally dimensioned through holes which are spaced apart in a staggered fashion. A generally rectangular rigid locking plate has a center slot to enable it to slide over and along the extended end of the strip orthogonal to the strip to press up against the closed door and the jamb. A locking pin inserted in one of the through holes in the strip holds the locking plate firmly and securely in place against the door and the door frame. Resilient pads are attached to the side of the locking plate facing the door and the door frame or jamb to prevent marring of the door and door frame surfaces and to permit the locking plate to be pushed firmly against the door and door jamb or frame so that when the locking pin is in place, the door is held firmly closed. The pads may differ in thicknesses to compensate for unevenness between the door and frame, e.g., if the door is not flush with the door frame, i.e., if the inner surface of the door and the inner surface of the door frame are not in the same plane when the door is closed, or if there is a molding on the door jamb. Also, at its inner end the strip is angled away from the door to make it easier to place the locking device in position when closing the door.

As one feature of the instant invention, the locking stud is machine pressed onto the strip to insure that it will not break loose if excess pressure is applied to the door. Another feature is that about one-half the length of the locking pin is knurled or otherwise roughened so that the pin will enter only half its length into the hole. In this fashion any force applied by the door to the locking plate is equally distributed over the full length of the locking pin. Also, the locking pin can be slightly twisted while being inserted in the hole so that the edge of the roughened surface will make a firm frictional fit within the hole to lessen the chance that the pin could be jiggled loose. Another feature is that the pads are made of different durometer material for reasons described later.

BRIEF DESCRIPTION OF THE DRAWINGS

FIG. 1 is a perspective view of the prior art;

FIG. 2 is a cross-section showing a portion of the door and the door jamb with the invention in use to secure the closed door; and FIG. 3 illustrates attachment of the locking stud to the locking strip.

DESCRIPTION OF THE PREFERRED EMBODIMENT

Since the prior art and the instant invention are similar, the same reference numerals are used for corresponding component parts in the prior art and the instant invention with reference to FIGS. 1 and 2. An elongated strip 10 made of a material having a suitable strength, preferably thirteen gauge sheet steel, has a stud 11 attached at one end which extends out orthogonally from one of the major surfaces of the strip 10 and engages a conventional striker plate opening 12 in a door jamb 13 for door 14. Conventionally, a spring-biased latch in the door normally engages the striker plate opening when the door is closed but with this invention the latch is recessed back into the door and is not shown for clarity. Strip 10 extends from the striker plate opening 12 through the space between the edge of the closed door 14 and jamb 13 into the interior of the room. The inner extending portion of strip 10 has a number of equally dimensioned through holes 15 which are spaced apart in a staggered fashion. At its furthest interior end 10A strip 10 is angled away from the door to make it easier to hold the strip in place after the stud has been inserted and while the door is being closed. A rigid generally rectangular locking plate member 16, also made out of a material of suitable strength, such as thirteen gauge sheet steel, has a central slot 17 for accommodating strip 10 so that locking plate 16 can be slid back and forth along strip 10. On the surface of locking plate 16 facing door 14 is an adhesively attached resilient pad 18 and facing door jamb or frame 13 is a thinner adhesively attached resilient pad 19. In the prior art (FIG. 1) a rigid locking pin 20 (FIG. 1) is suitably dimensioned and smoothly finished to snugly yet slidably engage holes 15 over its entire length and is tapered at one end 20A so it can be easily guided into the hole. One end of a chain 21 is attached to the other end of pin 20 and the other end of chain 21 is attached to strip 10 for convenience in keeping the two pieces joined together.

In use, door 14 is first held partially ajar to enable the stud 11 to be inserted into the striker hole 12 and door 14 is then closed and, if necessary, the strip 10 is pulled so that stud 11 rests against an edge of the striker hole 12. Locking plate 16 engaged with strip 10 via slot 17 is then pushed firmly against the door and the door jamb compressing pads 18 and 19 to make firm pressing contact against the door and the door jamb and then the locking pin 20 is inserted in a suitable hole 15 to hold the locking plate 16 secure. Essentially, the instant invention functions in the same fashion but with some differences.

As mentioned earlier, pads 18 and 19 may be of different thickness to accommodate any offset between the door jamb and the door. Typically, for example, the door jamb may have a molding around it so when the thicker pad 18 is pressed against the door the thinner pad 19 rests on the molding. As part of the instant invention the thicker pad 18 is made out of a relatively hard, slightly compressible rubber having in the order of about forty to fifty durometer while the thinner pad 19 is made out of a foam-like rubber having a high degree of compressibility as compared to the thicker pad 18. The low compressibility pad 18 is located on locking plate 16 opposite the door so when locking plate 16 is secured in place any force applied against the door will produce little or no movement of the door so that pin 30 (FIG. 2) cannot be jiggled out of hole 15 in strip 10. The higher compressible pad 19 also serves the function of allowing the locking pin 30 to be set into the best hole for holding the door tightly closed. For example, when locking plate 16 has been manually pushed firmly against the door, a hole 15 adjacent the locking plate 16 may be only partly open. By manually pushing locking plate 16 forcibly against the softer pad 19 to somewhat skew plate 16, the hole can be opened somewhat further so that pin 30 can then be inserted into the hole where it will then be holding the door closed as tightly as possible. To unsecure the door pin 30 can be removed in similar fashion.

As a further feature of the invention, one-half the length of pin 30, designated 30A, is smooth-surfaced and dimensioned so that it snugly yet slidably engages hole 15 similar to pin 20 while the other half, 30B, has a knurled or otherwise roughened surface so that pin 30 can be inserted only about half way into the appropriate hole. This distributes any force on the locking plate 16 equally over the length of pin 30 thereby minimizing the likelihood that pin 30 can be bent so that pin 30 would only give way by being sheared, which is highly unlikely. As an added feature, as the smooth length 30A of pin 30 is inserted into the appropriate locking hole 15 when the roughened or knurled surface 30B is reached the pin can be pushed and rotated so that the edge of the knurled section 30B will bite into the interior surface of hole 15 to help hold pin 30 securely in place and make it unlikely that the pin would fall or be jiggled loose out of the hole.

Another feature of the invention, as illustrated in FIG. 3, is the manner in which stud 11 is attached to strip 10. Initially strip 10 has a through hole 21 which is beveled at one end 22. Stud 11 is made out of the same round bar stock as an undercut smaller diameter rod 23 which is snugly pushed into hole 21 until the underside of stud 11 rests against the topside of strap 10 (as viewed in the drawing). An axial force is applied by a machine press to stud 11 and rod 23 to compress the latter so that it fills in the beveled area 22 and thereby firmly locks stud 11 onto strip 10 almost as a single integral unit.

We claim:

1. In a portable securing device for a door which is hingedly mounted in an opening which has a door jamb with a striker plate having an opening in the door jamb for receiving a latch, there being a space between the side edge of the door and the door jamb when the door is closed, said device having a rigid strip member resting in the space between the door and the door jamb, a rigid stud extending out from one surface of the strip member near one end for engaging the striker plate opening with the strip member extending beyond the inner plane of the door and the door jamb when the door is closed and having a plurality of equally dimensioned staggered holes, and a rigid locking plate member having a centered slot for engaging the strip member so that the locking plate member is slideably movable along the extended portion of the strip member with the locking plate extending over the door jamb and the door when the door is closed, the improvement comprising:

a slightly compressible pad member on the locking plate facing the door;

a highly compressible pad member on the locking plate facing the door jamb; and a locking pin engageable with one of the staggered holes in the strip for making pressing engagement against the locking plate when the locking plate is pressed firmly against the door, one-half of the length of the locking pin dimensioned to snugly but slidingly engage the hole the remaining half-length of the pin being roughened to prevent sliding engagement in the hole and to make biting frictional contact with the interior of the hole in the strip member.

2. The invention as described in claim 1 wherein the first pad member is substantially thicker than said second pad member.

3. The invention as described in claim 1 wherein said stud is a cylindrical solid member separate from the strip member which is machine pressed onto the strip member.

* * * * *